United States Patent [19]

Schmiedberg

[11] Patent Number: 4,958,718

[45] Date of Patent: Sep. 25, 1990

[54] ARTICLE CENTERING DEVICE

[75] Inventor: Winfried F. Schmiedberg, Pittsburgh, Pa.

[73] Assignee: SMS Engineering Incorporated, Pittsburgh, Pa.

[21] Appl. No.: 378,694

[22] Filed: Jul. 12, 1989

[51] Int. Cl.[5] ..... B65G 47/26

[52] U.S. Cl. ..... 198/456; 198/502.2; 198/774.1

[58] Field of Search ..... 198/502.2, 774, 434, 198/456

[56] References Cited

U.S. PATENT DOCUMENTS 4,236,626 12/1980 Noe ..... 198/774 X
4,270,655 6/1981 Noe ..... 198/774
4,387,800 6/1983 Noe ..... 198/774 X

FOREIGN PATENT DOCUMENTS 3443937 6/1986 Fed. Rep. of Germany ... 198/502.2
0235117 10/1987 Japan ..... 198/502.2

*Primary Examiner*—Joseph E. Valenza
*Assistant Examiner*—D. Glenn Dayoan
*Attorney, Agent, or Firm*—Clifford A. Poff

[57] ABSTRACT

The invention relates, in combination with a walking beam conveyor, to a width measuring and centering device for coils of rolled steel strip. The device interacts with the normal vertical raising, lowering and advancement of the coils, by the walking beam conveyor, wherein the device is traversed towards the coil when the coil is in a raised position to measure it width, after which the coil is lowered onto the device which then positions the coil on center, if necessary. After being centered the coil is lifted off the device by the walking beam conveyor and the device retracted after which the coil can be advanced by the conveyor.

11 Claims, 2 Drawing Sheets

ARTICLE CENTERING DEVICE

BACKGROUND OF THE INVENTION

This invention relates to a device for detecting in a processing line the presence of an object as it is being moved along a given path of travel and after the detection and as an incident thereof measuring one or more of its dimensions for use in the processing thereof.

While not so limited, the invention has particular usefulness in conjunction with the operation of conveyor systems for coils of rolled steel strip, such as employed at the entry ends of cold rolling mills that receives the coils one at a time prior to being introduced into the mills.

Such a coil entry end may include a conveyor for supporting and advancing a number of spaced separately supported coils in the direction of the mill, the conveyor being spaced from the mill by a coil unwinding machine that receive the coils from the conveyor for unwinding them individually into the mill. This machine may take the form of one or the other or both of a coil box or cone type uncoiler that support and rotate the coils to effect their initial unwinding.

These machines incorporate opposed axially adjustable coil engaging elements that are caused to contact opposed portions of the coils during their unwinding. It is important in the proper and efficient operation of these coil unwinding machines to be able to center the coils before they are brought to the machines. In the past this was done by trying to place the coils on the conveyor in the proper center line position or to provide a coil carrying unit that received the coils from the conveyor for physically moving the coils axially to the desired center line position. In these past arrangements and use of equipment the positioning in many cases was accomplished by human operation and control resulting in inaccuracy in the centering of the coils, in addition to lost time in the use of the mill equipment and manpower. While it was known in the prior art to employ coil width measuring means at the entry end of the mill to effect coil centering such art did not suggest measuring and centering of the coils while on the conveyor and as an incident of the normal movement thereof.

While the background of the invention has been described in connection with coils being fed to a rolling mill, reference should also be made to other types of coil processing operations where centering of the coils is required or desirable, such as for example coil preparation and processing lines.

BRIEF DESCRIPTION OF THE PRESENT INVENTION

The present invention relates to an article measuring and positioning device for use in combination with a conveyor while the coil is being carried thereby, and more particularly to a conveyor of the walking beam type.

Still more particularly, the invention relates to the employment of a coil centering device constructed to move from an inoperative position at one side of a walking beam to an operative position in a coil receiving position therewith while the coil is supported by the walking beam, during which movement the coil's width is automatically measured, the measurement information is then used to determine any off center condition relative to a data position, and if correction is required the coil is transferred from the walking beam to the device for movement to the on center position on further movement of the device before the coil is again placed back on the conveyor correctly centered. The interaction between the walking beam and device is such that the device is stationed at a certain location along the walking beam where the beam has an opening for receiving the device for allowing the transfer of the coil from the walking beam to the device and then back again.

Another feature of the invention is to provide for the automatic and efficient transfer of the coils from the walking beam conveyor to a coil car after the centering operation.

DETAIL DESCRIPTION OF THE PREFERRED EMBODIMENT OF THE INVENTION

Figure 1:
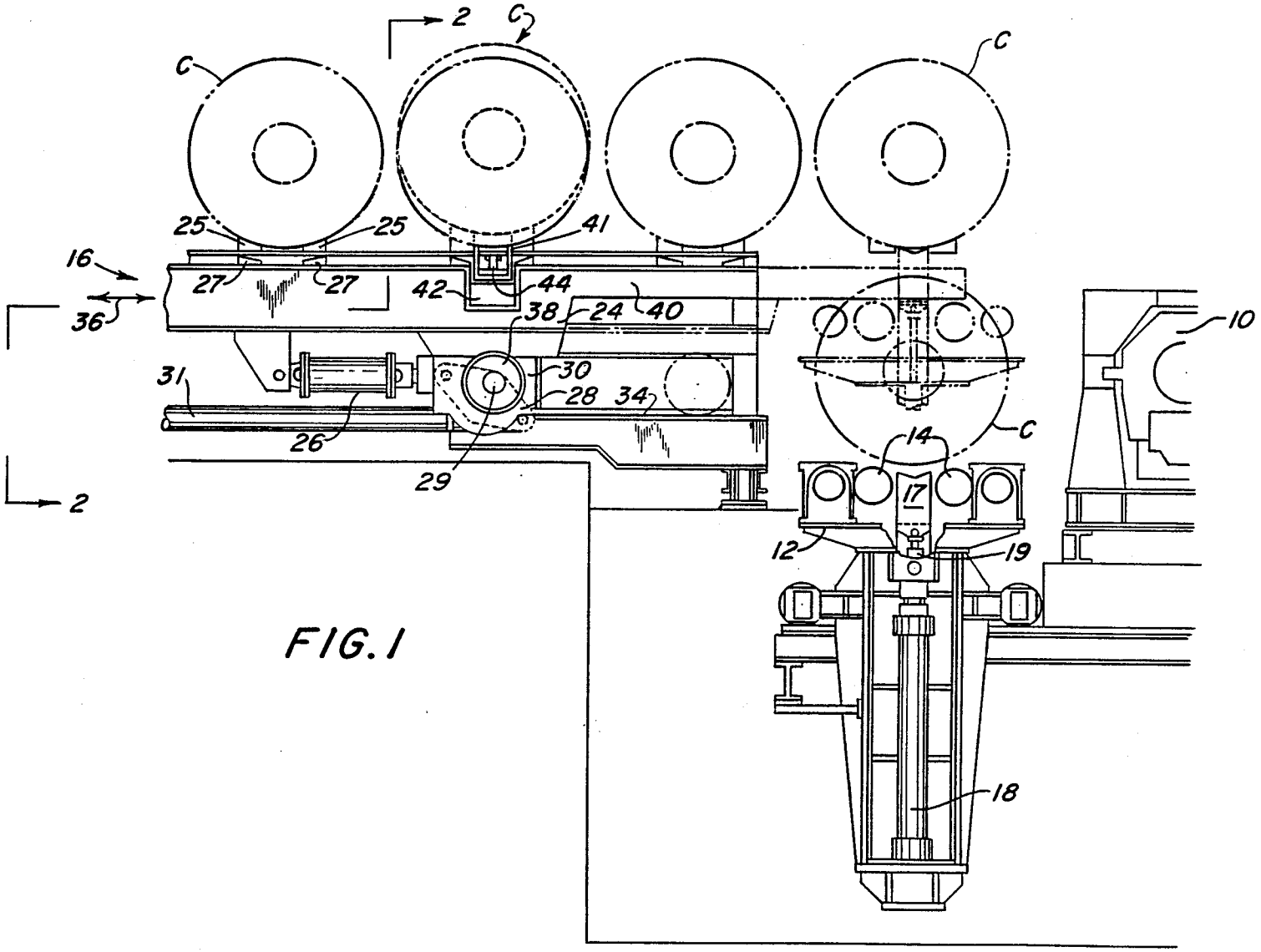
FIG. 1 is an elevational view of the entry end of a rolling mill illustrating the centering device and a portion of a walking beam in accordance with the present invention.

With reference to FIG. 1, there is shown the entry end of a tandem cold strip rolling mill, the mill not being shown. The mill is fed individually coils (C) from a drag uncoiler 10, which receives a coil from a coil car 12 that transports the coil from a station immediately to the left of the uncoiler 10, as one view FIG. 1, to the uncoiler where the coil is vertically positioned by the car to be engaged by the driven coil supporting cones (not shown) of the uncoiler. The coil car 12 includes a pair of driven sectioned rollers 14, which supports the coil after it is transferred from the walking beam conveyor 16 to the coil car, the rollers 14 being raised to the elevation of the conveyor and lowered to that of the uncoiler by a piston cylinder assembly 18, the raised position being shown in FIG. 1 in phantom. Since the construction and operation of the unit 10 is well known and is not considered part of the present invention no further description thereof is deemed necessary.

The coil car 12, while following generally well known designs, has one important improvement which is found in the employment of an auxiliary coil pick off device consisting of a coil U shaped lifting platform 17, which is raised and lowered by a piston cylinder assembly 19 independent of the piston cylinder assembly 18. The platform is constructed to engage the lower portion of a coil at two spaced points outside of the moveable coill supporting member 24 and the associated extensions. This construction allows the platform 17 to raise a coil off the member 24 and after the supporting member is retracted to lower the coil onto the rollers 14 of the coil car 12 from where it in turn can be lowered by operation of the piston cylinder assembly 18.

Turning now to the walking beam conveyor 16, this conveyor is in itself generally well known in the art as evidenced from West German Patents Nos. 2,250,244 dated July 11, 1974, 2,250,245 dated June 20, 1974, and D E 2,263,352 dated Sept. 17, 1981. To briefly summarize some of the important elements and operation of the conveyor and in also referring to FIG. 2, the conveyor includes two outer stationary parallelly arranged horizontal coil support members 20 and 22 between which on generally the same plane is positioned a vertically and horizontally moveable coil supporting member 24. As seen best in FIG. 1, in the same general horizontal location above the conveyor 16, the members 20, 22 and 24 are provided with cooperative pairs of coil supporting pads 25 and 27, the former being associated with the stationary members 20–22 and the latter with the movable member 24.

The vertical movement of the member 24 is accomplished by a piston cylinder assembly 26 pivotally connected to the stationary members 20 and 22 at its cylinder end and at its piston end to a lever 28, the mid point thereof being pivotally connected to a lower extension 30 of the movable member 24.

An eccentric, is provided as indicated at 29 in FIG. 1 through which the extension 30 is raised and lowered in a substantially true vertical direction. To the non-piston end of the lever 28, i.e its lower end, a connecting rod 31 is pivotally secured, the other end of which is connected to a similar levereccentric-extension arrangement spaced from the first arrangement along the conveyor 16 so that on operation of the piston cylinder assemblies 26 and 26' the entire moveable member 24 is raised and lowered in a substantial true vertical direction.

Figure 2:
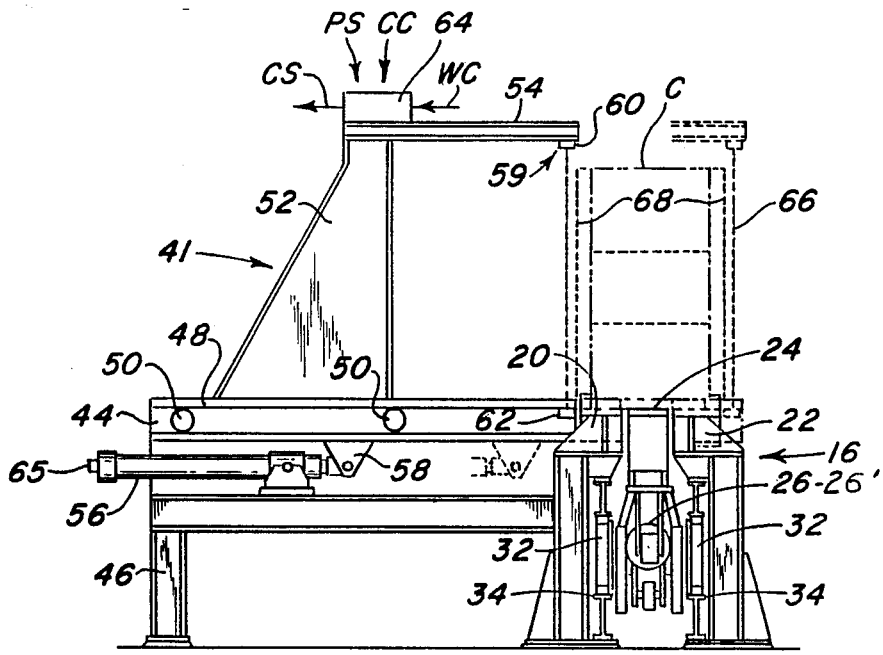
FIG. 2 is a section view taken on lines 2—2 of FIG. 1.

The extension 30 also serves to rotationally support spaced wheels 32, shown best in FIG. 2, which run on accommodating spaced horizontally arranged rails 34 by means of which the movable member 24 is moved towards and away from the coil car 12. The prime mover for this movement is a piston cylinder assembly, not shown, but indicated by the arrow 36 in FIG. 1.

To complete the description of the walking beam conveyor 16 and with reference again to FIG. 1, at the mill end of the conveyor and particularly with reference to the last pair of pads 27, the conveyor takes the form of an extension 40 in which on the upper surface the last pair of pads 27 are mounted and co-operate with the last pair of pads 25 of the stationary member, when the walking beam member 24 is in its retracted position as shown in FIG. 1.

The free end of the extension 40, as shown in phantom in FIG. 1, is adapted to be positioned over the coil car 12, when the beam member 24 is in its extreme right position, in which position the coil may be transferred from the conveyor 16 to the car by being received by its rollers 14, as again shown in FIG. 1 in phantom. A number, for example eight, coils are placed on the conveyor one at a time at the extreme left end of the conveyor as one views FIG. 1 and sequentially advanced to the mill end.

At the upper side of the conveyor 16, as one views FIG. 1, there is provided a centering unit 41, in which area it will be noted that both the stationary members 20 and 22 and the moveable member 24 are provided with co-operative U shaped openings (opening) 42 in their upper surfaces in the location of the second inward pads 25 and 27. Into this opening 42 is received a horizontal extending transversely moveable beam 44 of the unit 41, the unit as best shown in FIG. 2, has an inoperative position shown in hard line and an operative position in phantom.

The unit 41 consist generally of a sub-structure support 46 built up to place the beam 44 at the proper elevation with respect to the top of the conveyor 16 and more particularly the opening 42. In this area the structure 46 is provided with a horizontally extending tract 48 for receiving two pairs of spaced wheels 50, one wheel of each pair only being shown in FIG. 2. The structure has an upright member 52, to which an arm 54 is secured extending horizontally away from the member 52 so as to pass over a coil carried by the conveyor 16, shown in phantom in FIG. 2, when moved by a piston cylinder assembly 56 connected to the upright member 52 by a bracket 58 mounted on the lower side of the member 52.

To the outward extremities of both the lower portion of the upright member 52 and the arm 54, as shown in FIG. 2, there is mounted an electric eye unit 59 consisting of a well known type light beam emitter 60 and receiver 62. Associated with the electric eye unit is a control means 64, of a well known type have means for receiving several electrical signals of counting and measuring electrical pulses, one representing the interruption of the light beam and the re-establishment thereof as the emitter 60 and receiver 62 pass over and under the coil respectively, to measure the width of the coil.

FIG. 2, indicates some of the input and output signals which are designated by several leads, the lead representing the total stroke of the piston cylinder 56 marked "PS", the lead "CC" the distance from the beginning of the stroke PS to the edge of the coil, and the lead "WC" the measured width of the coil. Lastly the output lead "CS" represents the control signal that is fed to the piston cylinder assembly 56. The PS, CC and WC signals can be generated by well known electrical pulse counters, only one of which is indicated with the piston cylinder assembly 56 at 65.

In expressing the function of the control means 64 mathematically the following equation is given:

$$CS = CC + WC \pm \text{Offset Adjustment},$$

Where:

CC = distance between beginning of piston stroke to edge of coil,

WC = measured width of coil.

The control means 64 includes well know means for comparing the measurement of the width of the coil with an electrical signal representing a distance from a given point to the left thereof, and the center of the conveyor and hence the uncoiler 10, thereby to determine if an on center or off center condition prevails as to the position of the coil under inspection relative to the center of the conveyor. If the coil is off centered either to the left or right, as one views FIG. 2, the control means 64 having determined both the degree of off centerness and direction thereof relative to the center line of the conveyor 16 will effect an operation of the piston cylinder assembly 56 to place the coil on the center of the conveyor 16. The control means may take several well known forms of computer processors available on the market for use in steel industry applications.

The outer dash lined 66 in FIG. 2 represents the vertical viewing plane of the electric eye unit 59, and the second set of inner dash lines 68 the viewing error zone provided for on each side of the coil to be measured, the coil C shown in FIG. 2, being the maximum width coil wherein the width of the error zone approximates five inches. The control means 64, automatically allows for a predetermined error in the ability of the moving electric eye to register its detection of the ends of the coil in the generating of the electric signal representing the width of the coil. The speed of the piston cylinder assembly 56 and hence the traverse speed of travel of the electric eye unit 59 over the coil will be maintained so as to obtain a proper working condition.

Figure 3:
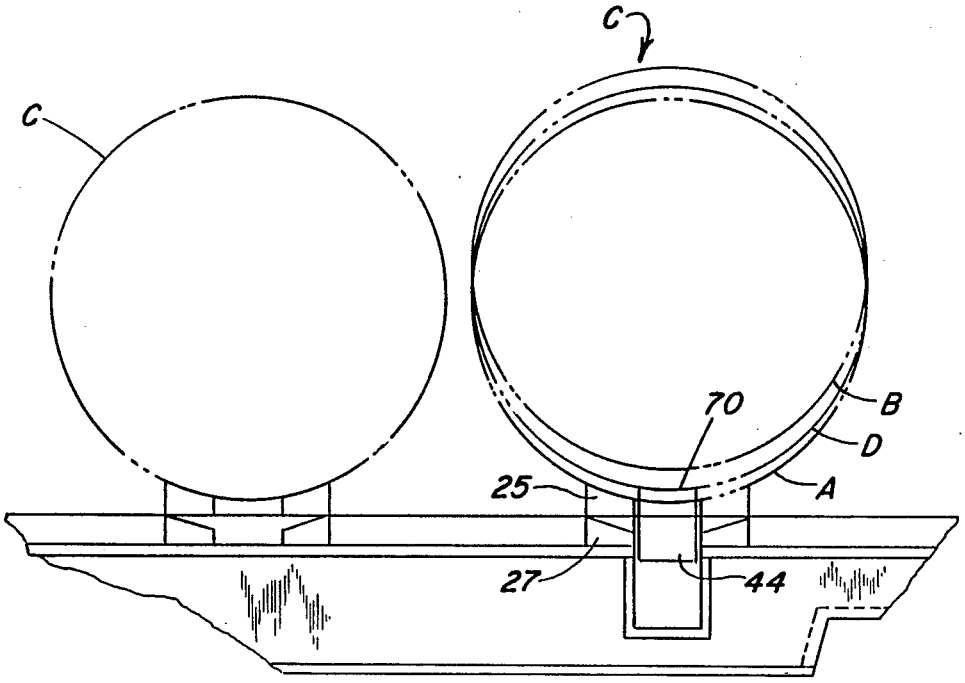
FIG. 3 is an enlarged portion of FIG. 1 at the coil centering station.

In order to more fully explain the transfer of the coil from the conveyor 16 to the beam 44 during the coil width measuring and centering operation reference will now be made to FIG. 3. This figure serves to illustrate three positions assumed by a maximum diameter coil C when in the coil measuring station of the conveyor 16. In position marked A the coil is carried by the pads 25 of the stationary members 20 and 22. In position marked B, the coil has been raised by operation of the position cylinder assembly 26 where the coil is lifted off the pads 25 by the moveable member 24 and carried by the pads 27 thereof. In this raised position clearance is provided for the beam 44 to be advanced under the coil in operation of the piston cylinder assembly 56, during which movement the coil's width is determined and its off center relationship if any, as noted above. If an off center condition exist the moveable member 24 is lowered to place the coil on the beam 44, which position is marked D, in which the coil is supported on the "V" shaped surfaces 70 of the beam 44.

Once so positioned, the beam will be moved as dictated by the control means 64 to place the coil on center relative to the center of the conveyor 16 after which the moveable member 24 will be again raised, the beam 44 withdrawn to its inoperative position shown in FIG. 2, and the moveable member 24 lowered to place the coil C on the pads 25 of the stationary members 20 and 22. From here the coil is transferred to the last set of pads 25 of the stationary members and then finally by the moveable member 24 to a position over the coil car 12 to be lifted off by the car, as previously described, to allow the moveable member 24 to be retracted. Once the coil car 12 is lowered the moveable member will be free to advance the next coil. It will be appreciated that after a measured coil has been placed in the end position of the conveyor 16, the width of the next adjacent coil can be measured and centered, if necessary, by the cooperative interaction of the conveyor 16 and the centering device 41, wherein the normal coil transfer action between the stationary members 20 and 22 and the moveable member 24 is designed to cooperate with the coil carrying phase of beam 44 of the centering unit 41.

The coil illustrated represents the maximum OD and width, in which the equipment illustrated is designed to handle a range of different diameters and widths of hot rolled steel band. The maximum diameter coil may be of the order of approximately 76 inches, the minimum approximately 42 inches, in which the maximum coil may have a weight of approximately 50,000 pounds. The range of widths of the coils may approximate from 28 to 40 inches.

Although a preferred embodiment has been described, it will be apparent to one skilled in the art that changes can be made therein without departing from the scope of the invention.

I claim:

1. The combination of a walking beam conveyor and a workpiece measuring and centering device, the conveyor including cooperative stationary and moveable workpiece supporting means, means for raising, lowering and longitudinally moving said moveable walking beam supporting means relative to said stationary supporting means such that in one position said moveable supporting means falls below a workpiece supported by said stationary supporting means and in a second position above said stationary supporting means, whereby in the latter case the workpiece is lifted off said stationary supporting means, said longitudinal movement being in a given path of travel, said moveable workpiece supporting means having an opening arranged transverse of said path of travel, the device including a workpiece supporting means constructed and arranged to pass into said opening from one side of the conveyor when said moveable walking beam supporting means is in said second position, and for receiving and supporting a workpiece from said moveable walking beam supporting means, the device including a workpiece measuring means arranged so that when the device is traversed into said opening with a workpiece carried by said moveable walking beam supporting means a measurement is made of a selected portion of the workpiece, means for moving the workpiece supporting means of the device to and from the conveyor, and control means for determining from said measurement any off center condition of said workpiece relative to a given data position and for effecting an operation of said means for moving said supporting means of the device to center said workpiece when the workpiece is transferred from said moveable walking beam supporting means to said supporting means of the device.

2. The combination according to claim 1, wherein said workpiece measuring means includes an electric eye system.

3. The combination according to claim 1, wherein said control means includes a signal representing at least a portion of the predetermined total movement of said device with reference to a second signal representing the position of a first side of said workpiece supported on said conveyor and means for comparing signals representing said measured value of said workpiece with said second signal to determine the degree of centerness of the workpiece.

4. The combination according to claim 1, wherein the conveyor includes means for causing said moveable walking beam supporting means to be raised and lowered in substantially a vertical direction.

5. The combination according to claim 1, wherein said workpiece consists of a coil of rolled steel strip.

6. The combination according to claim 2, wherein said device takes the form of a C shaped frame having upper and lower parallelly arranged arms, and means for mounting the emitter and receiver of said electric eye system at the ends of said arms so as to pass over and under adjacent and remote sides of the workpiece carried by said moveable walking beam supporting means of the conveyor.

7. The combination according to claim 1, wherein said opening is also formed in said walking beam stationary supporting means of the conveyor.

8. The combination according to claim 1, wherein said second position is such so as to allow the supporting means of the device to pass under a workpiece when carried by said moveable walking beam supporting means and said means for causing the raising and lowering of said moveable walking beam supporting means causes said moveable walking beam to assume a third position where the workpiece is caused to be transferred from the walking beam supporting means of the conveyor to said supporting means of the device.

9. The combination according to claim 1, wherein said means for moving said moveable walking beam supporting means includes separate means for moving said moveable walking beam supporting means longitudinally.

10. The combination according to claim 1, wherein said conveyor has entry and delivery ends, said stationary and moveable workpiece supporting means includes a number of cooperative coil supporting members spaced along the conveyer, and said opening of said moveable workpiece supporting means and the device are arranged to co-operative with said coil supporting members preceding the last said members most adjacent to said delivery end of the conveyor.

11. The combination according to claim 1, including means for lifting a workpiece off said conveyor after it has been centered by said device, said lifting means including a workpiece transfer car means, said car means having a first means for engaging a workpiece supporting by said conveyor to lift the workpiece off said conveyor so that the conveyor can be moved away from the transferred workpiece, said car means having a second means for receiving and supporting a workpiece from said first means, and said second means including means for receiving and transferring a workpiece supported by said second means to a location remote from said conveyor.

* * * * *